US006250912B1

(12) United States Patent
Widdowson

(10) Patent No.: US 6,250,912 B1
(45) Date of Patent: Jun. 26, 2001

(54) LIQUID FUEL LAMP

(75) Inventor: Richard E. Widdowson, Clayton, OH (US)

(73) Assignee: Widdowson Enterprise Inc., Clayton, OH (US)

( * ) Notice: Subject to any disclaimer, the term of this patent is extended or adjusted under 35 U.S.C. 154(b) by 0 days.

(21) Appl. No.: 09/658,746

(22) Filed: Sep. 11, 2000

Related U.S. Application Data

(60) Provisional application No. 60/153,928, filed on Sep. 14, 1999.

(51) Int. Cl.[7] ..... F23D 3/18; F23D 3/24

(52) U.S. Cl. ..... 431/324; 431/320; 431/343; 248/312.1

(58) Field of Search ..... 431/320, 321, 431/322, 323, 324, 343, 345, 296, 289; 126/45, 30, 29, 49; 248/312.1

(56) References Cited

U.S. PATENT DOCUMENTS

| | | | | |
|---|---|---|---|---|
| Re. 31,702 | | 10/1984 | Brown . | |
| D. 317,059 | | 5/1991 | Menter . | |
| D. 387,446 | | 12/1997 | Bell et al. . | |
| 2,216,886 | * | 10/1940 | Langelier | 126/30 X |
| 2,441,242 | * | 5/1948 | Harkins | 431/154 |
| 2,520,818 | * | 8/1950 | Terry . | |
| 2,541,390 | * | 2/1951 | Weigand . | |
| 2,811,031 | * | 10/1957 | Russ, Jr. | 431/320 |
| 2,884,216 | * | 4/1959 | Joecks . | |
| 3,321,938 | * | 5/1967 | Bureau | 431/321 |
| 3,661,351 | * | 5/1972 | Olsen . | |
| 3,730,379 | | 5/1973 | Brown . | |
| 3,905,754 | * | 9/1975 | Maddestra et al. | 431/324 |
| 3,994,672 | * | 11/1976 | Novak | 431/320 |
| 4,035,138 | * | 7/1977 | Walters | 431/320 |
| 4,494,926 | * | 1/1985 | Riha | 431/321 |
| 4,624,633 | * | 11/1986 | Bandel | 431/320 |
| 4,689,727 | | 8/1987 | Perkins . | |
| 5,669,767 | * | 9/1997 | Bureau et al. | 431/320 |

FOREIGN PATENT DOCUMENTS

| | | | | |
|---|---|---|---|---|
| 100865 | * | 5/1937 | (AU) | 431/296 |
| 10-132215 | * | 5/1998 | (JP) | 431/324 |
| 9704272 | | 2/1997 | (WO) . | |

* cited by examiner

*Primary Examiner*—Carl D. Price
(74) *Attorney, Agent, or Firm*—Biebel & French LPA

(57) ABSTRACT

A liquid fuel lamp which may be easily converted from a conventional beverage container. The liquid fuel lamp includes a container having a cylindrical wall connected to opposing top and bottom walls. The top wall includes an opening defined by a pair of side edges. A wick assembly is removably received within the opening in the top wall. The wick assembly includes a tubular metal sleeve supporting a substantially planar wick. Liquid fuel is received within the container wherein a lower portion of the wick is received in adsorbing contact with the liquid fuel. A stand is provided for supporting the container in an elevated position.

15 Claims, 5 Drawing Sheets

LIQUID FUEL LAMP

CROSS-REFERENCE TO RELATED APPLICATION

This application claims the benefit of U.S. Provisional Patent Application Serial No. 60/153,928, filed Sept. 14, 1999.

BACKGROUND OF THE INVENTION

1. Field of the Invention

The present invention relates to liquid fuel lamps and, more particularly, to an oil lamp including a conventional beverage container in combination with a wick assembly and support stand.

2. Description of the Prior Art

It is well known to use oil lamps for both decorative and lighting purposes. Such oil lamps are often used at outdoor venues, particularly where they may be placed around decks or patios. Conventional oil lamps typically include a wick in adsorbing contact with a liquid fuel which burns for providing light. A plurality of these lamps may be arranged in a desired manner to provide an aesthetically pleasing appearance.

While such outdoor oil lamps have become quite popular for entertaining purposes, these lamps are often unnecessarily elaborate and prohibitively expensive. Furthermore, such oil lamps are often bulky or awkward, and generally inconvenient to store.

In apparent recognition of some of the drawbacks of traditional outdoor oil lamps, U.S. Pat. No. 4,035,138 to Walters discloses an apparatus for converting a beverage container into a lamp. While this apparatus has addressed many of the shortcomings of the above-identified conventional oil lamps, it still suffers from certain drawbacks. Initially, it should be noted that the Walters patent is tailored to a beverage container having a removable pull tab, which when removed leaves a sector shaped discharge opening in the top wall of the beverage container. This type of container is generally no longer produced for dispensing beverages. Additionally, the preferred wick holder of the Walters device may be pushed relatively easily through the opening of the container. Finally, the Walters device provides a round wick which typically produces a relatively limited light output.

Accordingly, there is a need for an oil lamp including a wick holder for securely holding a wick within a beverage container opening while providing an improved light output and an aesthetically pleasing appearance. Further, there is a need for a support stand for supporting the oil lamp in an elevated position.

SUMMARY OF THE INVENTION

The present invention provides a liquid fuel lamp which may be easily converted from a conventional beverage container and which provides a structure for securely holding a wick within the container while providing an improved light output and an aesthetically pleasing appearance.

The liquid fuel lamp of the present invention includes a container having a cylindrical sheet metal wall defining a longitudinal container axis. Opposing top and bottom sheet metal walls are fixed to the cylindrical wall wherein the top wall includes an opening extending substantially outwardly in a radial direction from proximate the longitudinal container axis. The opening is defined by a pair of side edges spaced apart in a substantially perpendicular direction to the radial direction of the opening by a maximum distance $d_0$.

A wick assembly is received within the opening in the top wall. The wick assembly includes a tubular metal sleeve having a lower cylindrical portion and an upper tapered portion. The upper tapered portion has a substantially elliptical cross-section having a major diameter $d_e$. A substantially planar wick is received within the sleeve and is releasably fixed to the upper tapered portion such that a portion of the wick extends above the upper end of the sleeve. In turn, the upper end of the sleeve extends above the top wall of the container.

In a first preferred embodiment of the invention, the major dimension $d_e$ of the tapered portion of the sleeve is greater than the maximum distance $d_o$ of the opening in the top wall. As such, the sleeve deforms the side edges of the opening and the top wall retains the wick assembly in a suspended position. Liquid fuel, preferably lamp oil, is received within the container wherein a lower portion of the wick is received in adsorbing contact within the liquid fuel.

The wick assembly further includes an annular ring having an outer diameter $d_r$ and coaxially receiving the tubular sleeve. The annular ring is fixed to the upper tapered portion above the opening of the container. The outer diameter $d_r$ of the annular ring is greater than the maximum distance $d_o$ between the side edges of the top wall. In a second preferred embodiment of the present invention, the lower surface of the annular ring engages the top wall for providing the primary means of supporting the wick assembly within the container.

The liquid fuel lamp of the present invention further includes a stand for supporting the container. The stand preferably includes a wire helix forming a plurality of successive convolutions for supporting the side wall of the container. A base support is formed integral with the lowermost convolution and engages the bottom wall of the container. A support leg extends vertically downwardly from the base support and may be placed within the ground or a preformed bore for supporting the lamp.

In an alternative embodiment, the stand comprises a clip releasably secured to a vertically extending support rod. The clip includes a support leg extending above, and partially overlapping, a connector. The connector extends between the support leg and a securing leg. The support rod is received within a pair of coaxially aligned apertures formed within the support leg and the connector. The top wall is removably received intermediate the connector and the securing leg.

Therefore it is an object of the present invention to provide an improved liquid fuel lamp which is inexpensive and easily assembled by combining household items and components from a kit.

It is a further object of the present invention to provide such a liquid fuel lamp which is aesthetically pleasing.

It is another object of the present invention to provide an improved liquid fuel lamp including a wick assembly which is securely fixed to the top wall of a conventional beverage container by deformably engaging the side walls of the opening formed in the top wall.

It is a further object of the present invention to provide an improved liquid fuel lamp which provides improved light output.

It is yet another object of the present invention to provide a liquid fuel lamp having a wick assembly which maintains a substantially planar wick in absorbing contact with liquid fuel stored within a container and which facilitates easy insertion and withdrawal of the wick assembly through an opening in the container.

It is a further object of the invention to provide such a wick assembly which facilitates filling the container with liquid fuel without requiring complete removal of the wick assembly.

It is a further object of the present invention to provide a liquid fuel lamp which provides a positive flame line.

It is another object of the invention to provide a liquid fuel lamp including a wick assembly having an annular ring for supporting the wick assembly within the opening of a container and covering such opening.

Other objects and advances of the invention will be apparent from the following description, the accompanying drawings and the appended claims.

DESCRIPTION OF THE PREFERRED EMBODIMENTS

Figure 1:
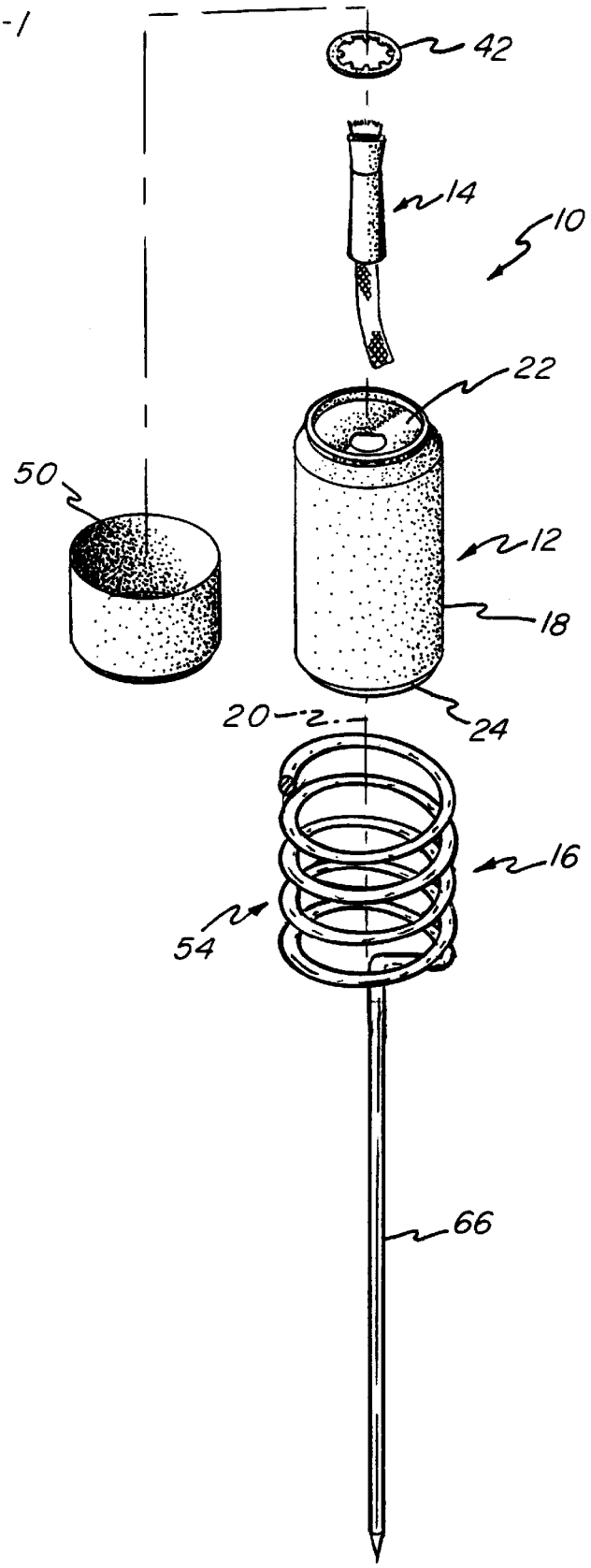
FIG. 1 is an exploded perspective view of the liquid fuel lamp of the present invention.
Figure 2:
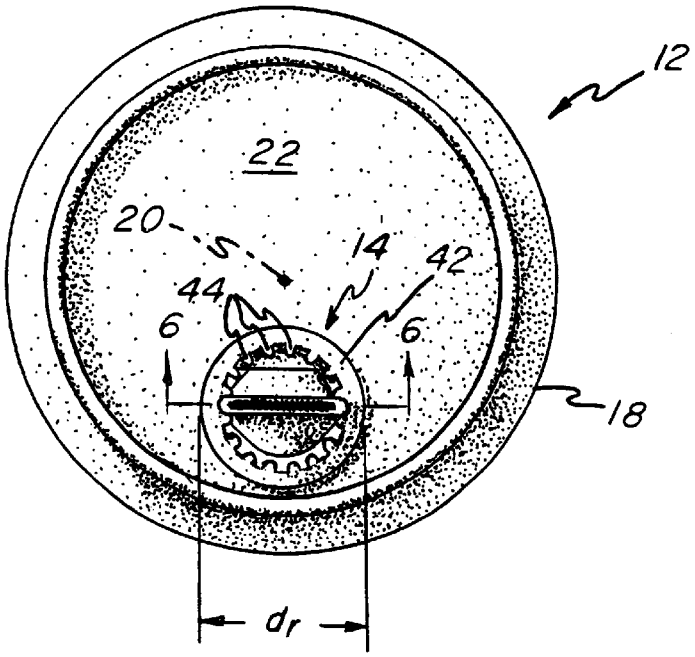
FIG. 2 is a top plan view of the liquid fuel lamp of FIG. 1.

Referring initially to FIGS. 1 and 2 of the drawings, the liquid fuel lamp 10 of the preferred embodiment of the present invention is illustrated as including a container 12, a wick assembly 14, and a support stand 16. The container 12 is preferably a conventional metal beverage can of the type well known in the art. This can may comprise the type disclosed in detail in U.S. Patent No. Re. 31,702 to Brown, which is incorporated herein by reference. While the beverage can of the type disclosed in U.S. Patent No. Re. 31,702 is preferably used in the present invention, it should be appreciated that similar containers may be readily substituted therefore.

Figure 3:
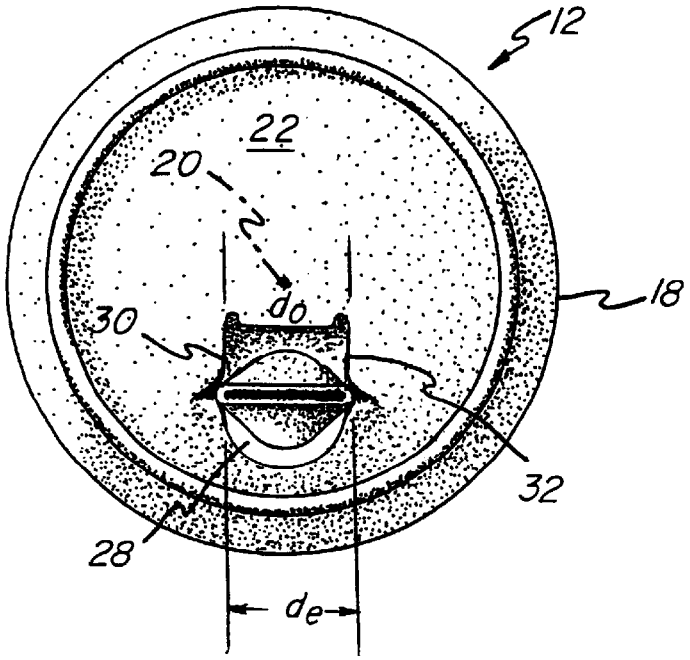
FIG. 3 is a top plan view of the liquid fuel lamp of FIG. 2 with the annular ring removed for clarity.

The container 12 includes a cylindrical wall 18 formed of sheet metal and defining a longitudinal container axis 20. Top and bottom walls 22 and 24, also formed of sheet metal, are fixed to opposing ends of the cylindrical side wall 18. A tab and tear strip (removed for clarity) are connected to the top wall 22 wherein the tab forces the tear strip downwardly along a score line to form an opening 28 (FIG. 3). The opening 28 extends from proximate the longitudinal container axis 20 radially outwardly. More particularly, the opening 28 is defined by a pair of side edges 30 and 32 which are spaced apart in a direction transverse to or substantially perpendicular to the radial direction of the opening 28. As illustrated in FIG. 3, the side walls 30 and 32 are spaced apart in this transverse direction by a maximum distance $d_0$.

With further reference to FIGS. 2–5, the wick assembly 14 is supported within the opening 28 and is offset from the longitudinal container axis 20. The wick assembly 14 includes a conventional substantially planar wick 34 received within a tubular metal sleeve 36. The sleeve 36 includes a lower cylindrical portion 38 integrally formed with an upper tapered portion 40. The upper tapered portion 40 includes a substantially elliptical cross-section having a major dimension $d_e$ (FIG. 3). An annular ring 42 having an outer diameter $d_r$ is supported on the tapered portion 40 and includes a plurality of radially inwardly extending teeth 44 for securely engaging the sleeve 36.

Figure 4:
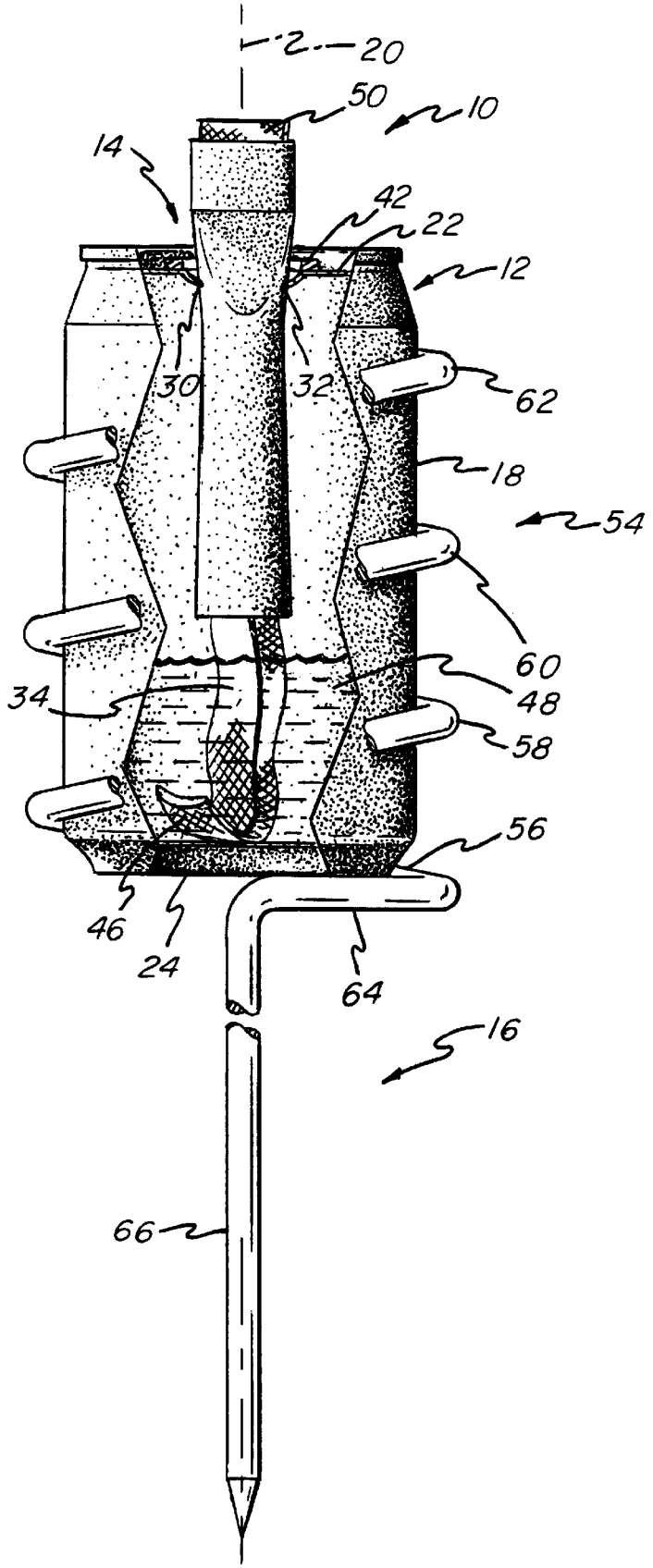
FIG. 4 is a front elevational view, with a partial cut away, of the liquid fuel lamp of FIG. 2.
Figure 5:
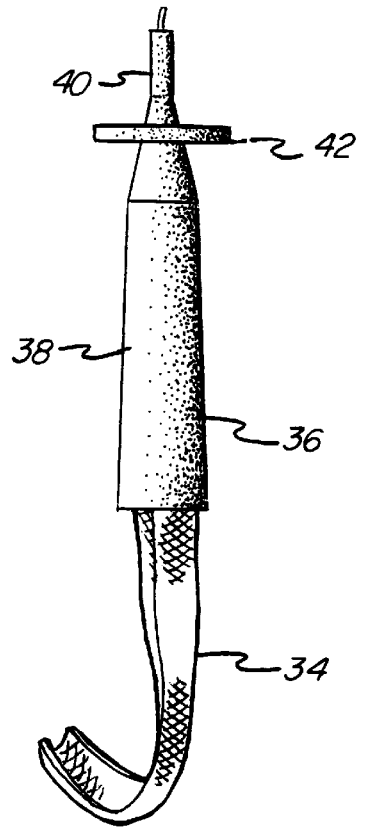
FIG. 5 is a side elevation view of the wick assembly of FIG. 4.

Turning now to FIG. 4, the wick assembly 14 is dimensioned so that when supported by the top wall 22 of the container 12, a lower end 46 of the wick 34 is positioned within a liquid fuel 48 received within the container 12. The liquid fuel 48 preferably comprises a conventional lamp oil which is readily available from a variety of sources. While the container 12 may be filled after the original contents thereof are removed, it is envisioned that the container 12 may be prefilled and sealed with liquid fuel 48. As is known in the art, the wick 34 absorbs the liquid fuel 48 such that an upper end 50 of the wick 34 contains the fuel 48 for burning.

Figure 6:
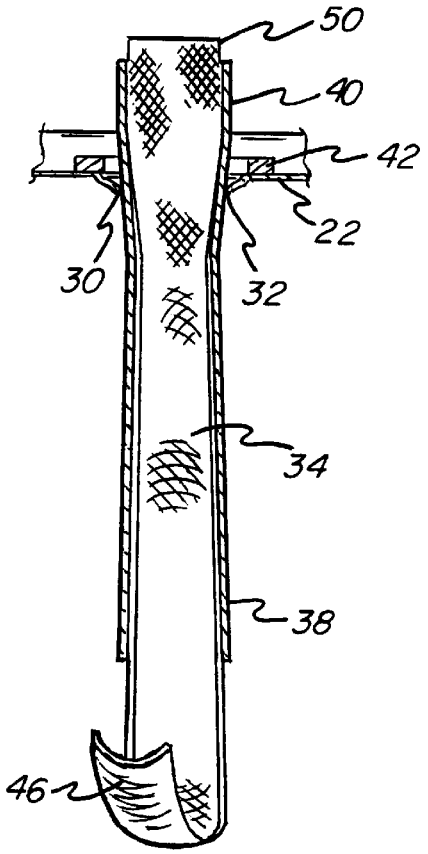
FIG. 6 is a cross-sectional view taken along the line 6—6 in FIG. 2.

With further reference to FIGS. 3, 4 and 6, the wick assembly 14 is preferably fixed to the top wall 22. In one preferred embodiment, the major dimension $d_e$ of the tapered portion 40 of the sleeve 36 is greater than the maximum distance $d_o$ of the opening 28 in the top wall 22 such that the sleeve 36 deforms the side edges 30 and 32 of the opening 28. This interference with, or deformation of, the side edges 30 and 32 retains the wick assembly 14 in a suspended position within the container 12. The annular ring 42 in this embodiment serves as a secondary support and also covers the opening 28 of the container 12 to help prevent accidental spillage of the liquid fuel 48 while also providing an aesthetically pleasing appearance.

In a second preferred embodiment of the present invention, the annular ring 42 provides the primary means for supporting the wick assembly 14 within the container 12. More particularly, the ring 42 is fixed to the tapered portion 40 of the sleeve 36 above the opening 28 of the container 12. The outer diameter $d_r$ of the ring 42 is greater than the maximum distance do between the side edges 30 and 32 such that the lower surface of the ring 42 engages the top wall 22 thereby supporting the wick assembly 14 within the container 12.

As illustrated in FIG. 1, the liquid fuel lamp 10 of the present invention may further include a lid 50 for covering the wick assembly 14 and top wall 22. More particularly, the lid 50 essentially forms a seal with the side wall 18 of the container 12 such that the flame of the wick 34 may be extinguished. The lid 50 is preferably formed of a lower portion of a second beverage container 12.

With further reference to FIGS. 1 and 4, the stand 16 for supporting the container 12 preferably comprises a wire formed into a partial helix 54. The partial helix 54 includes a plurality of successive convolutions 56, 58, 60 and 62 for supporting the side wall 18 of the container 12. A base support 64 is formed integral with the lowermost convolution 56 and extends substantially horizontally to proximate the longitudinal container axis 20 for contacting the bottom wall 24. A support leg 66 extends vertically downwardly from the base support 64 and is preferably coaxially aligned with the longitudinal container axis 20.

Figure 7:
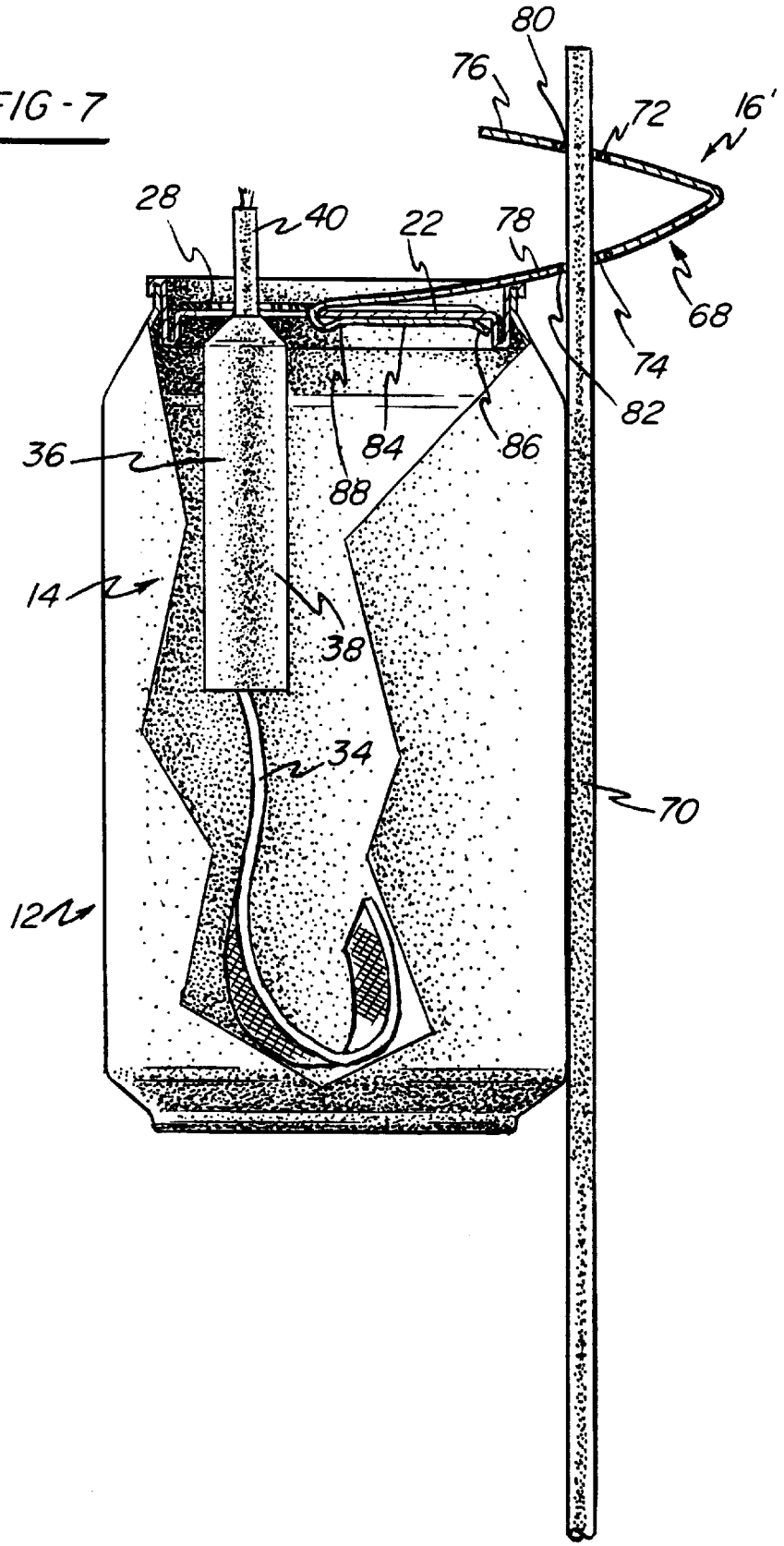
FIG. 7 is a side elevational view, with a partial cut-away, of the liquid fuel lamp of the present invention, illustrating an alternative embodiment of the stand.

An alternative embodiment of the support stand 16', as illustrated in FIG. 7, includes a clip 68 supported by a vertically extending support rod 70. Moreover, the rod 70 is releasably secured to the clip 68 and extends through coaxially aligned apertures 72 and 74 formed within a support leg 76 and a connector 78. The clip 70 is preferably formed of spring steel such that the support leg 76 is biased upwardly away from the connector 78 wherein the rod 70 frictionally engages side edges 80 and 82 of the apertures 72 and 74.

A securing leg 84 is supported below the connector 78, wherein the top wall 22 of the container 12 is received therebetween. An entry bend 86 is formed within the securing leg 84 to assist the user in passing the clip 68 through the opening 28 and into engagement with the top wall 22. A locking bend 88 is also preferably formed within the securing leg 84 for clamping the top wall 22 intermediate the connector 78 and the securing leg 84.

While the forms of apparatus herein described constitute a preferred embodiments of this invention, it is to be understood that the invention is not limited to these precise forms of apparatus, and that changes may be made therein without departing from the scope of the invention, which is defined in the appended claims.

What is claimed is:

1. A liquid fuel lamp comprising:

a container having a cylindrical sheet metal wall defining a longitudinal container axis;

opposing top and bottom sheet metal walls fixed to said cylindrical wall, said top wall including an opening extending substantially outwardly in a radial direction from proximate said longitudinal container axis, said opening formed by removal of a tear strip and defined by a pair of side edges spaced apart in a direction substantially perpendicular to said radial direction by a maximum distance $d_o$;

a wick assembly received within said opening in said top wall, said wick assembly including a sleeve having a lower cylindrical portion and an upper tapered portion, said upper tapered portion having a substantially elliptical cross-section having a major dimension $d_e$, a substantially planar wick received within the sleeve and fixed to said upper tapered portion; and wherein said major dimension $d_e$ of said tapered portion of said sleeve is greater than said maximum distance $d_o$ of said opening, and said tapered portion of said sleeve deforms said side edges of said opening in a direction radially outwardly from said sleeve such that said top wall retains said wick assembly in a suspended position.

2. The liquid fuel lamp of claim 1 wherein said wick assembly further includes an annular ring coaxially receiving and supported by said sleeve.

3. The liquid fuel lamp of claim 2 wherein said annular ring includes a plurality of radially inwardly extending teeth for engaging said sleeve.

4. The liquid fuel lamp of claim 1 further including a stand supporting said container.

5. The liquid fuel lamp of claim 4 wherein said stand comprises a support leg, a base support for engaging said lower wall of said container, and a helix forming a plurality of successive convolutions for supporting said side wall of said container.

6. The liquid fuel lamp of claim 4 wherein said stand comprises a vertically extending rod and a clip releasably supported by said rod, said clip extending within said opening and including a securing leg and a connector biased toward said securing leg, said top wall of said container releasably secured intermediate said securing leg and said connector.

7. The liquid fuel lamp of claim 4 wherein said stand comprises a vertically extending rod and a clip releasably supported by said rod, said clip including a connector and a support leg supported above said connector, said support leg and said connector including apertures for receiving said rod, said support leg biased away from said connector for frictionally engaging said rod.

8. The liquid fuel lamp of claim 1 wherein said wick assembly is proximate a center of said opening in said top wall and offset from said longitudinal axis of said container.

9. The liquid fuel lamp of claim 1 further comprising a lid for engaging said side wall and substantially sealing said wick assembly, said lid formed of a bottom portion of a second one of said containers.

10. A liquid fuel lamp including:

a container having a cylindrical sheet metal wall defining a longitudinal container axis;

opposing top and bottom sheet metal walls fixed to said cylindrical wall, said top wall including an opening extending substantially outwardly in a radial direction from proximate said longitudinal container axis, said opening defined by a pair of side edges spaced apart in a direction substantially perpendicular to said radial direction by a maximum distance $d_o$;

a wick assembly received within said opening in said top wall, said wick assembly including a sleeve having a lower cylindrical portion and an upper tapered portion, said upper tapered portion having a substantially elliptical cross-section having a major dimension $d_e$, and a substantially planar wick received within said sleeve and fixed to said upper tapered portion; and a stand for supporting said container in an elevated position.

11. The liquid fuel lamp of claim 10 wherein said stand comprises a wire helix forming a plurality of successive convolutions for supporting said side wall of said container, a base support integral with the lowermost one of said successive convolutions for engaging said lower wall of said container, and a support leg extending vertically downwardly from said base support.

12. The liquid fuel lamp of claim 9 wherein said stand comprises a vertically extending rod and a clip releasably supported by said rod, said clip extending within said opening and including a securing leg and a connector biased toward said securing leg, said top wall of said container releasably secured intermediate said securing leg and said connector.

13. The liquid fuel lamp of claim 9 wherein the major dimension $d_e$ of said tapered portion of said sleeve is greater than said maximum distance $d_o$ of said opening, and said sleeve deforms said side edges of said opening such that said top wall retains said wick assembly in a suspended position.

14. The liquid fuel lamp of claim 10 wherein said stand comprises a vertically extending rod and a clip releasably supported by said rod, said clip including a connector and a support leg supported above said connector, said support leg and said connector including apertures for receiving said rod, said support leg biased away from said connector for frictionally engaging said rod.

15. A liquid fuel lamp comprising:

a container having a cylindrical wall defining a longitudinal container axis;

opposing top and bottom walls fixed to said cylindrical wall, said top wall including an opening extending substantially outwardly in a radial direction from proximate said longitudinal container axis, said opening defined by a pair of side edges spaced apart in a direction substantially perpendicular to said radial direction by a maximum distance $d_o$;

a wick assembly received within said opening in said top wall, said wick assembly including a sleeve having a lower cylindrical portion and an upper tapered portion, a substantially planar wick received within said sleeve and fixed to said upper tapered portion, and an annular ring having an outer diameter dr and fixed to said sleeve above said opening;

wherein said outer diameter $d_r$ of said annular ring is greater than said maximum distance $d_o$ between said side edges and a lower surface of said annular ring engages said top wall for supporting said wick assembly within the container; and a stand including a vertically extending rod and a clip releasably supported by said rod, said clip including a securing leg and a connector biased toward said securing leg, said top wall of said container releasably secured intermediate said securing leg and said connector, said clip further including a support leg supported above said connector, said support leg and said connector including apertures for receiving said rod, wherein said support leg is biased away from said connector for frictionally engaging said rod.

* * * * *